US005141124A

United States Patent [19]

Smith et al.

[11] Patent Number: 5,141,124

[45] Date of Patent: Aug. 25, 1992

[54] REFUSE CONTAINER WITH SNAP-ON COVER

[75] Inventors: Fred P. Smith; Fred T. Smith, both of Alpine, Utah

[73] Assignee: The Heil Co., Milwaukee, Wis.

[21] Appl. No.: 788,970

[22] Filed: Nov. 7, 1991

Related U.S. Application Data

[62] Division of Ser. No. 506,330, Apr. 9, 1990.

[51] Int. Cl.[5] ..... B65D 43/00

[52] U.S. Cl. ..... 220/334; 220/335; 220/908

[58] Field of Search ..... 220/334, 335, 908, 337, 220/338

[56] References Cited

U.S. PATENT DOCUMENTS

| | | | |
|---|---|---|---|
| 3,392,820 | 7/1968 | Azim | 220/335 X |
| 3,888,386 | 6/1975 | Svensson | 220/335 X |
| 4,399,928 | 8/1983 | Klinger | 220/335 |
| 4,441,637 | 4/1984 | Libit | 220/335 X |
| 4,450,976 | 5/1984 | Snyder et al. | 220/908 X |
| 4,789,078 | 12/1988 | Miller et al. | 220/335 |
| 4,836,394 | 6/1989 | Glomski | 220/335 X |
| 4,887,747 | 12/1989 | Ostrowsky et al. | 220/335 X |
| 4,942,271 | 7/1990 | Corsi et al. | 220/338 X |
| 5,048,715 | 9/1991 | Wolff | 220/335 |
| 5,071,024 | 12/1991 | Delmerico et al. | 220/335 |

*Primary Examiner*—Steven M. Pollard
*Attorney, Agent, or Firm*—Paul R. Puerner

[57] ABSTRACT

A refuse container has a lid that is hinged thereto without the use of mechanical fasteners. The container has short shafts extending therefrom. The lid has arms that pivotally receive and are captured on the container shafts. The shafts are formed with sectors, and the lid arms have recesses that receive the sectors. The lid arms recesses define stepped surfaces located at predetermined locations relative to the container sectors so as to positively stop the lid at a desired open position. The lid arms may be formed with dual radius recesses connected by a flat surface. The container sectors and the recess surfaces are dimensioned to enable the lid to be freely pivoted to an intermediate open position approximately 90° from a closed position and subsequently in a controlled manner to a third open position approximately 270° from the first position. The mold for making the container and lid has a flat parting surface.

13 Claims, 3 Drawing Sheets

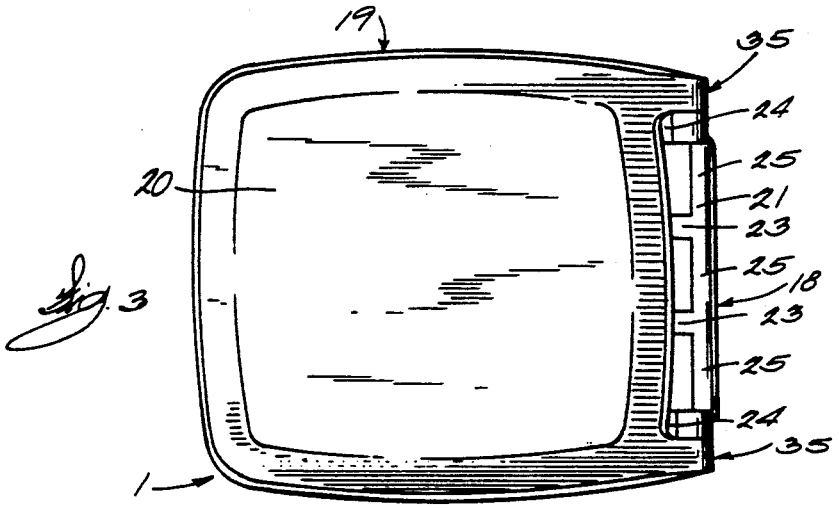
Fig. 3
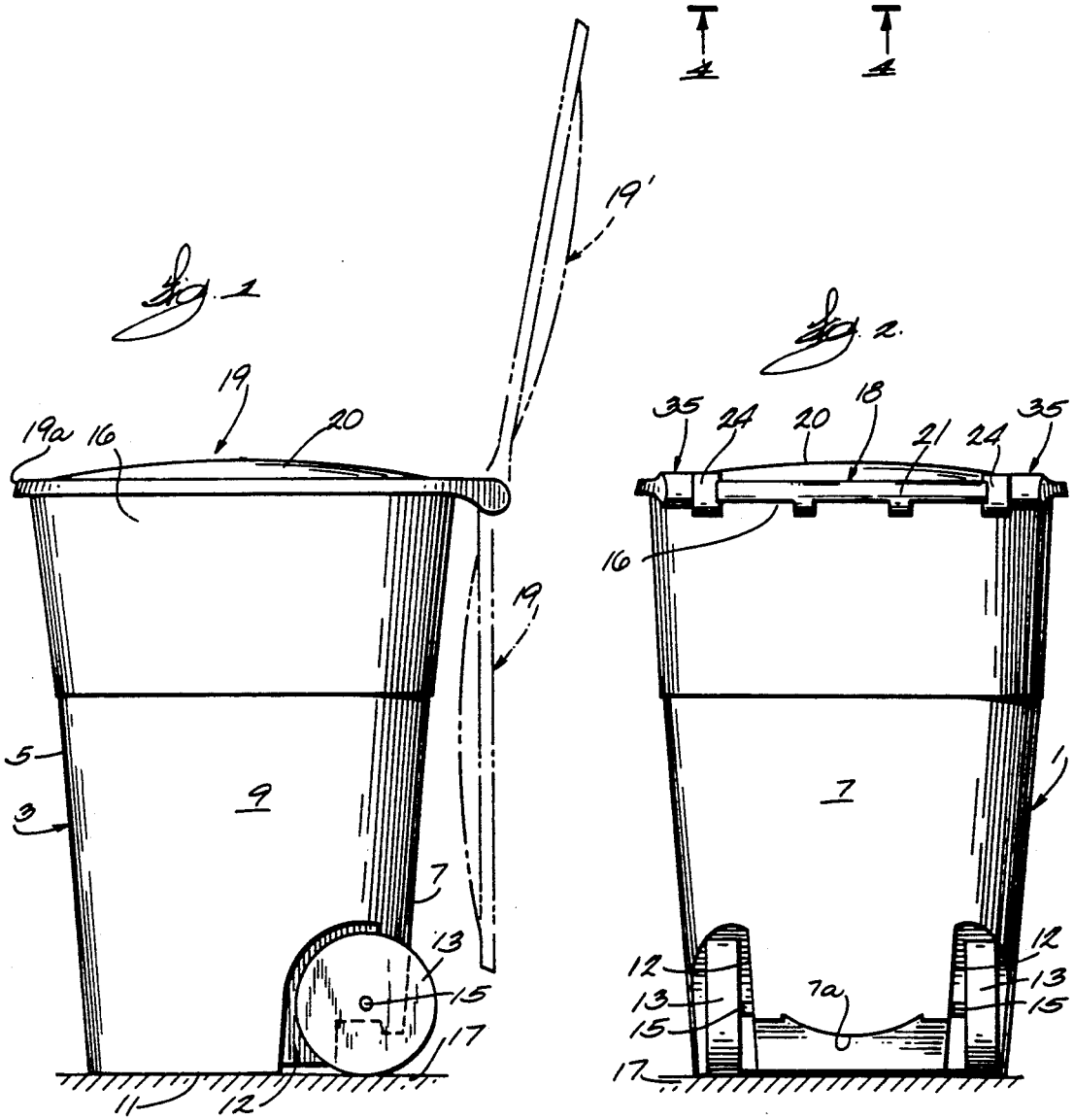
Fig. 1
Fig. 2

Fig. 10
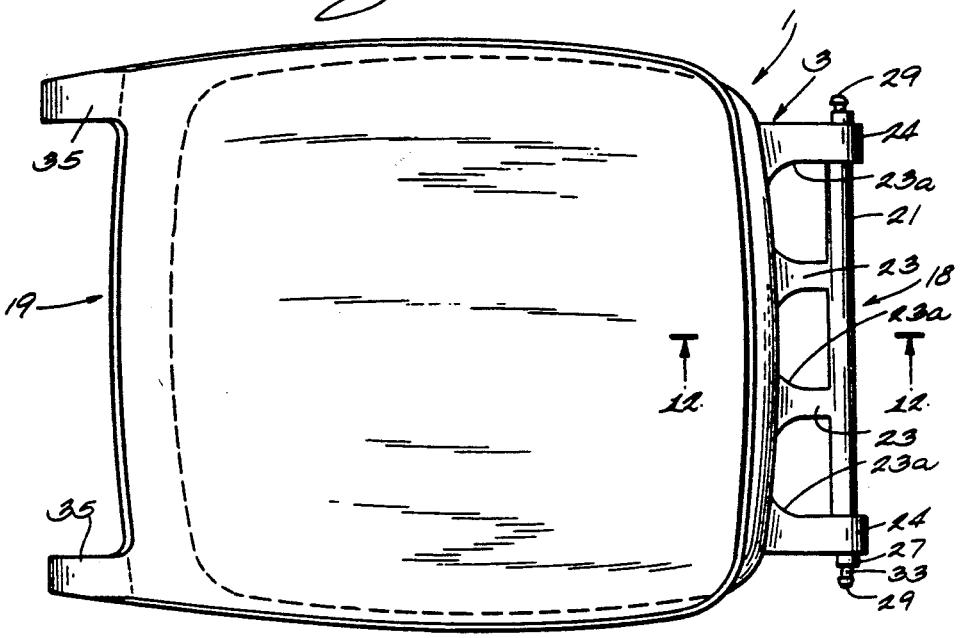
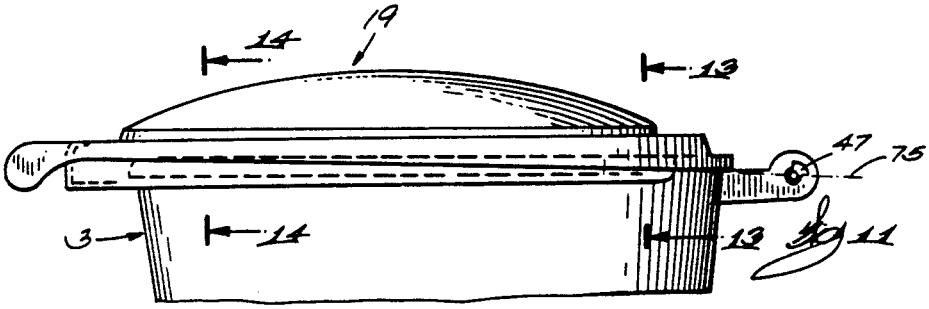
Fig. 11
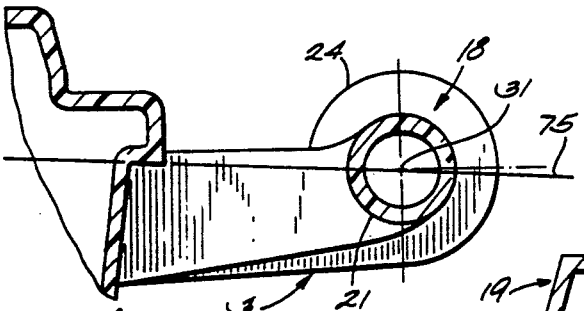
Fig. 12
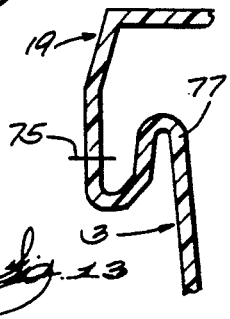
Fig. 13
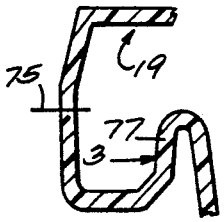
Fig. 14

REFUSE CONTAINER WITH SNAP-ON COVER

This is a divisional of copending application Ser. No. 07/506,330 filed on Apr. 9, 1990.

BACKGROUND OF THE INVENTION

1. Field of the Invention

This invention pertains to waste handling, and more particularly to apparatus for temporarily storing waste materials.

2. Background of the Invention

Various types of receptacles have been developed to temporarily store and transport waste products. For example, receptacles that include a wheeled container for holding the refuse and a lid pivotally connected to the container are well known. Some types of receptacles are designed to be handled and emptied by automatic equipment. Typical examples of prior receptacles are shown in U.S. Pat. Nos. 4,450,976 and 4,749,101.

The receptacle lids may be retained on the containers by various means, such as mechanical fasteners. On the other hand, the lid may be hinged directly to a handle that is an integral part of the container. In some designs, the lid is pivotable from a closed position overlying the top of the container through approximately 100° to an open position whereat it is generally vertical and above the hinge. In other receptacles, the lid is pivotable from the closed position through approximately 270° to an open position whereat the lid is generally vertical and below the handle. Ideally, a single lid is selectively openable to both the 100° and the 270° positions.

However, prior receptacles employ rather makeshift designs for enabling the lids to have 100° and 270° stop positions. In some cases, the 100° stop is achieved by manually moving the lid pivot point such that the lid strikes the container handle to provide the stop. In prior receptacles, swinging the lid from the 100° position to the 270° position is uncontrolled, and the rapidly rotating lid tends to strike the bottom of the container and tip the container over as the lid approaches its lowermost position.

An additional disadvantage of prior receptacles is that it is difficult to satisfactorily convert a container and lid having a 100° lid opening to one with a 270° opening. Consequently, a user must order and stock two entirely different receptacles if he has applications requiring both openings.

Thus, a need exists for improvements in refuse receptacles.

SUMMARY OF THE INVENTION

In accordance with the present invention, a refuse receptacle is provided in which a lid is controllably pivotable about a container. This is accomplished by apparatus that includes cooperating stops and cams incorporated into a hinge connecting the container and lid.

The container is manufactured from a rather flexible plastic material. The container has front, back, and side walls and a generally horizontal open top into which waste materials are deposited. An elongated horizontal handle is formed integrally with the container back wall adjacent the top thereof. The ends of the handle terminate in oppositely extending shafts. The free end of each shaft is formed with a mushroom-shaped surface; the two mushroom-shaped surfaces diverge toward each other. Each shaft has a circumferential groove adjacent the base of the corresponding mushroom-shaped surface.

The lid is designed with a cover portion that fits snugly over the container walls adjacent the tops thereof. Like the container, the lid is made of rather flexible plastic material. The lid includes two arms that extend from the cover portion. The arms have respective inwardly facing surfaces that are spaced apart a distance slightly greater than the distance between the opposite ends of the container handle. The arms are formed with recesses in their respective inwardly facing surfaces. At the bottom of each recess is a circular opening that extends through a middle wall and into a clearance chamber. The clearance chamber may be partially bounded by an outside wall of the arm.

The lid is hinged to the container by means of the container shafts and lid arms. The opening in an arm middle wall is aligned axially with a shaft mushroom-shaped surface. The lid arm is then pushed over the container shaft to force the shaft mushroom-shaped surface through the lid opening such that the shaft circumferential groove (or neck portion) is received in the lid opening to capture the lid in the groove. Then the lid is flexed to align the opening in the middle wall of the second lid arm with the shaft on the second end of the container handle, and the lid is pushed onto and captured by the circumferential groove in the handle second end. The result is a receptacle having a hinge between the container and lid that does not require any mechanical fasteners and that is completely hidden so as to provide an attractive appearance.

The receptacle of the present invention is designed to enable the lid to pivot between a horizontal first position whereat it is snugly snapped over the container open top and a generally vertical second position whereat the lid is in an open position approximately 100° from the first position. To positively locate the lid at the second position, the receptacle hinge is fabricated with cooperating stops. In the preferred embodiment, the hinge stops comprise a radially extending sector formed on each container shaft and a stepped surface on each lid arm. Each container sector is joined to the shaft adjacent the circumferential groove opposite the mushroom-shaped surface. Each sector has a radius slightly less than the radius of the arm recess and a radial end face. The sector is received in the arm recess.

To positively locate the lid at the second position, the stepped surface of the lid stop forms a boundary of the recess of each lid arm. The stepped surface extends radially of the arm middle wall opening. When the lid is in the horizontal first position, the stepped surfaces of the two lid arms are approximately 100° from the end faces of the corresponding container sectors. The lid is thus pivotable about the container shafts for approximately 100° until the lid stepped surfaces strike the sector end faces. As a consequence, the lid is positively located at the open second position, where it remains until it is intentionally closed.

Further in accordance with the present invention, the receptacle hinge may be designed such that the lid is freely pivotable between the first closed position and an intermediate position and is controllably pivotable from the intermediate position to a third position approximately 270° from the first position. For that purpose, the receptacle hinge includes friction cams acting between the container and the lid. The hinge cams may utilize the same sectors on the container shafts as are used with the positive 100° stops described previously.

To provide controlled camming action with the container sectors, each lid arm recess is formed with two arcuate surfaces and an interconnecting flat surface. The first arcuate surface has a radius slightly greater than the radius of the container sector. The arm second arcuate surface has a radius that is slightly less than the sector radius. The interconnecting flat surface extends tangentially from the second arcuate surface to intersect the first arcuate surface. When the lid is in the horizontal first position on the container, the container sectors fit inside the first arcuate surfaces of the corresponding arm recesses, and the intersection of the recess tangential surface and the recess first arcuate surface is approximately 75° from the container sector end face. The cam dimensions thus enable the lid to be rotated freely through approximately 90°. Further lid rotation past the 90° causes the arm tangential surfaces to contact the associated container sectors in a gradual camming action. Additional lid rotation is possible until the lid has undergone 270° of rotation from the first position. However, for approximately 180° of rotation, the second arcuate surfaces of the arm recesses are in frictional contact with the container sectors. As a consequence, lid rotation is slow and controlled, and the danger of a rapidly dropping lid overturning the receptacle when the lid reaches the 270° position is eliminated.

Other advantages, benefits, and features of the invention will become apparent to those skilled in the art upon reading the detailed description of the invention.

BRIEF DESCRIPTION OF THE DRAWINGS

FIG. 1 is a side view of the receptacle of the present invention.

FIG. 2 is a back view of the present invention.

FIG. 3 is a top view of FIG. 1.

FIG. 10 is a top view of the receptacle as molded.

FIG. 11 is a partial side view of FIG. 10.

FIG. 12 is a partial cross-sectional view taken along lines 12—12 of FIG. 10.

FIG. 13 is a partial cross-sectional view taken along lines 13—13 of FIG. 11.

FIG. 14 is a partial cross-sectional view taken along lines 14—14 of FIG. 11.

DETAILED DESCRIPTION OF THE INVENTION

Figure 4:
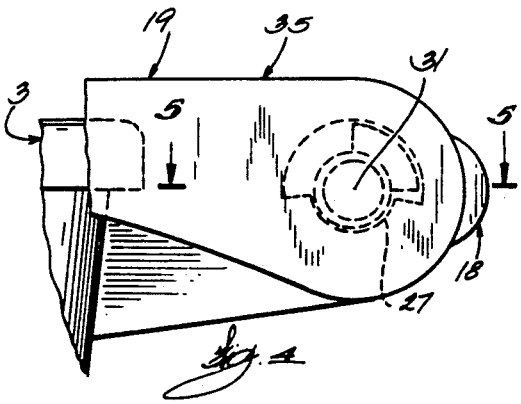
FIG. 4 is an enlarged view taken along lines 4—4 of FIG. 3.

Referring to FIGS. 1-3, a receptacle 1 is illustrated that includes the present invention. The receptacle is particularly useful for temporarily storing and transporting waste materials, but it will be understood that the invention is not limited to refuse handling applications.

The receptacle 1 comprises a large container 3, which may have a capacity of approximately 90-100 gallons. The container 3 is fabricated with a front wall 5, back wall 7, two opposed side walls 9, and a floor 11. The side walls 9 may have respective cut-outs 12 to accommodate wheels 13 that are rotatably mounted to respective axles 15. In turn, the axles 15 are secured to the container to enable the container to be rolled along the ground 17. The back wall 7 is provided with an arc shaped toe rest **7*a*** to make it easier to tip the container.

Integral with the container back wall 7 near the top 16 thereof is an elongated handle 18. The handle 18 may be formed as a horizontal bar 21 connected to the top end 16 of the back wall by two inner supports 23 and two outer supports 24 so as to form three grabbing areas 25. In that manner, a person may use one or both hands to easily manipulate the container 3. The base areas **23*a* of supports 24 and 23 (FIG. 10) are curved to provide added strength to the handle 18**.

The container 3 has an open top that is selectively coverable by a lid 19. The lid 19 has a cover portion 20, which, when the lid is in the closed position of FIGS. 1-3, fits over the top ends of the container front, back, and side walls 5, 7, and 9, respectively. Preferably, a tight snap fit exists between the lid cover portion 20 and the rolled top edge **3*a* (FIG. 8**) of the container so as to prevent insects and rodents from reaching the inside of the container.

Figure 5:
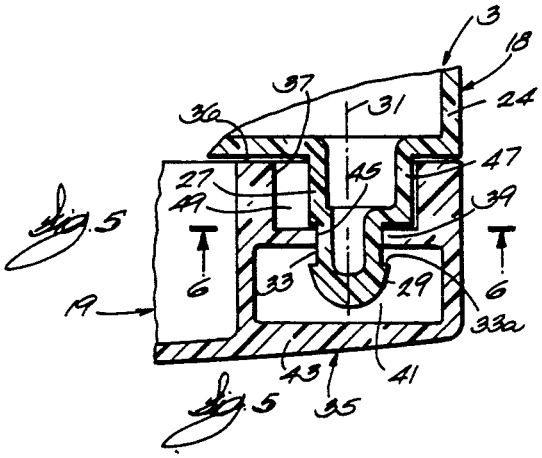
FIG. 5 is a cross-sectional view taken along lines 5—5 of FIG. 4.

In accordance with the present invention, the lid 19 is hinged to the container 3 in manner that does not require any mechanical fasteners and that also is aesthetically pleasing. Turning to FIGS. 4 and 5, an outwardly extending shaft 27 is joined to each handle outer support 24. Each shaft 27 terminates in a neck portion 33 (or groove) having a tapered mushroomshaped head 29 formed thereon to provide a shoulder **33*a*** therebetween.

To mate with the container shafts 27, the lid 19 is provided with a pair of arms 35 that project backwardly from the cover portion 20. Each arm 35 has an inwardly facing surface 36 with a recess 37 partially bounded by a middle wall 39. Each arm is further formed with a chamber 41 defined partially by the middle wall 39 and by an outer wall 43. The arm middle wall 39 has an opening 45 therethrough. The opening 45 has a diameter slightly greater than the diameter of the container neck 33 but smaller than the diameter of the container shaft 27. The diameter of head 29 is slightly greater than the diameter of opening 45.

Both the container 3 and the lid 19 are manufactured from a relatively flexible thermosetting plastic material. The four container walls 5, 7, and 9, as well as the floor 11, may be approximately 0.02" thick. The lid cover portion 20 may also have a thickness of 0.02". Consequently, the container and lid are slightly flexible.

To assemble the lid 19 to the container 3, one of the lid arms 35 is placed adjacent the corresponding container shaft 27 such that the shaft is aligned with the arm opening 45. The mushroom-shaped head 29 is placed against the arm opening. Then a tap with a mallet on the arm outer wall 43 forces the arm opening over the head 29 and into engagement with the neck 33. The arm is thus captured on the container shaft by shoulder 33A.

Then the lid 19 is flexed to bring the opening 45 of the other arm 35 into alignment with the second container shaft 27. Another tap with the mallet forces the arm opening over the head 29 of the second container shaft. In that manner, the container shafts 27 and lid arms cooperate to form a hinge between the container 3 and lid 19 that requires no additional fasteners and that is neatly hidden from sight.

Further in accordance with the present invention, the receptacle hinge includes stops that limit lid pivoting between a first position whereat the lid 19 is generally horizontal and in engagement with the container 3 and a second position whereat it is approximately 100° from the first position. Looking also at FIG. 6, each container shaft 27 is formed with a radially extending sector 47 that may subtend an angle of approximately 90°. Preferably, the sector 47 spans the distance between the shaft groove 33 and the handle support 24. The sector 47 has a radius that is slightly less than the radius of the lid arm recess 37. The sector has a first end face 49 and a second end face 51. In the particular construction illustrated, the sector first end face 49 is generally vertical and the second end face 51 is generally horizontal, but those orientations are not required.

To limit the pivoting of the lid 19 on the container shaft 27, the lid stop is composed of a stepped surface 53 formed as part of the arm recess 37. The stepped surface 53 extends radially of the axis 31 and between the inner radius of the recess 37 and an arcuate surface 55. The arcuate surface 55 has a radius that is slightly greater than the radius of the container shaft 27. The arcuate surface 55 may subtend an angle of approximately 165°, and it terminates in a second stepped surface 57 similar to the stepped surface 55.

Figure 6:
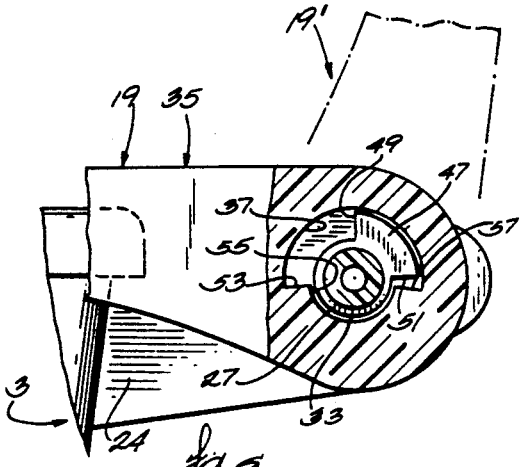
FIG. 6 is a cross-sectional view taken along lines 6—6 of FIG. 5.

When the lid 19 is in the first position, which is generally horizontal and snapped in place on the container 3 as shown by the solid lines of FIGS. 1, 4, and 6, the lid stepped surface 53 is approximately 100° from the container sector end face 49, and the lid stepped surface 57 is proximate the sector second end face 51. Accordingly, the lid may be pivoted clockwise with respect to FIGS. 1, 4, and 6 through approximately 100° until the lid stepped surface 53 abuts the sector end face 49. At that point, the lid is in the position 19' shown in phantom lines in FIGS. 1 and 6. The lid is retained in the second position by gravity until it is intentionally reclosed.

Figure 9:
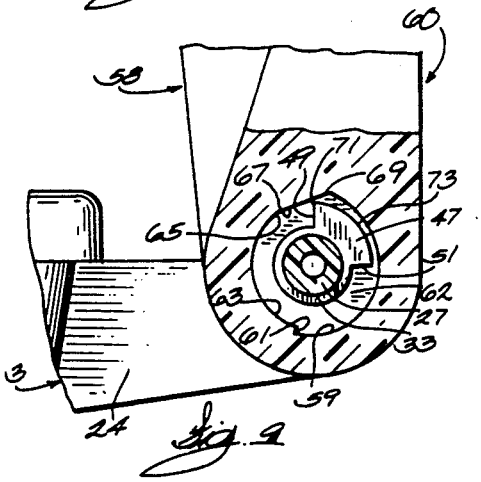
FIG. 9 is a view similar to FIGS. 7 and 8, but showing the lid at a position intermediate the first and third positions.
Figure 7:
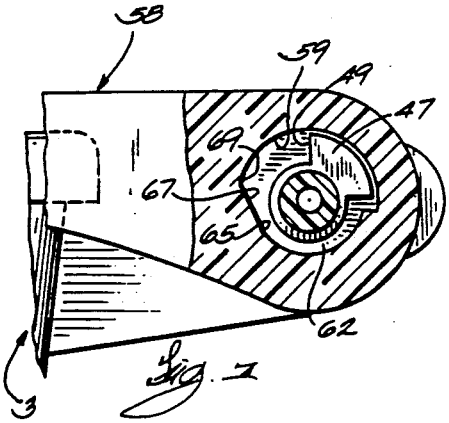
FIG. 7 is a view similar to FIG. 6, but showing a modified embodiment of the present invention.
Figure 8:
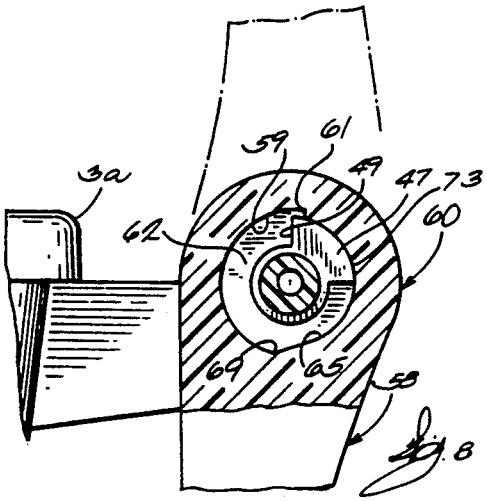
FIG. 8 is a view similar to FIG. 7, but showing the lid at an open third position.

It is a feature of the present invention that the receptacle lid may be opened to a third position approximately 270° from the first position in a controlled and safe manner. For that purpose, the hinge between the container and lid is modified from the positive stop design shown in FIGS. 4 and 6 to a frictional cam design illustrated in FIGS. 7–9. In the frictional cam hinge, the container shaft 27, including the neck 33 and the sector 47, remain the same as with the stop design described previously. In FIGS. 7–9, the lid 58 has two arms 60 with respective recesses 62. Each recess 62 is partially defined by a first arcuate surface 59 that has a radius that is slightly greater than the radius of the container sector 47. A radial stepped surface 61 extends between the first arcuate surface 59 and a second arcuate surface 63. The second arcuate surface 63 has a radius slightly less than the radius of the sector 47. The second arcuate surface preferably subtends an angle of approximately 155° from the stepped surface 61 to a point 65 at which the arcuate surface 63 blends into a flat surface 67 that is tangential to the arcuate surface 63. The tangential surface 67 intersects the first arcuate surface at point 69.

When the lid 58 is in the first, horizontal position closed over the container 3, FIG. 7, the intersection point 69 between the first arcuate surface 59 and the tangential surface 67 is approximately 75° from the first end face 49 of the container sector 47. From the first position, the lid is freely pivotable about the container shafts 27 in a clockwise direction with respect to FIG. 7 toward the position of FIG. 9. The lid tangential surface 67 is dimensioned such that it contacts the corner 71 between the sector periphery 73 and the first end face 49 when the plane of the lid is in a generally vertical attitude, FIG. 9.

From the position of FIG. 9, the lid 58 is further pivotable in a clockwise direction to the third position of FIG. 8. However, lid pivoting between the intermediate position of FIG. 9 and the third position of FIG. 8 is in a controlled manner that allows smooth and safe descent. Lid control is achieved by the frictional contact of the peripheries 73 of the container sectors 47 initially with the lid tangential surfaces 67 and subsequently with the arcuate surfaces 63. Initial controlled lid pivoting from the intermediate position of FIG. 9 clockwise through an angle of approximately 30° is the result of a gradually increasing camming contact between the sector peripheries 73 and the lid tangential surfaces 67. After the lid has pivoted approximately 120° from the first position thereof, the lid tangential points 65 between the respective tangential surfaces and the arcuate surfaces 63 are proximate the sector corners 71. Further lid pivoting from that position is in a uniformly resisted manner with frictional contact between the sector peripheries and the constant radius arcuate surfaces 63. Untimately, the lid reaches the third position of FIG. 8 after rotating through approximately 270° from the first position. Because of the frictional resistance between the container and lid, the lid descends slowly and safely to the third position, eliminating the usual tendency of the centrifugal force of the lid to tip the container backwards.

An outstanding advantage of the present invention is that a single container 3 is interchangeable with both lid 19 for 100° rotation of the lid and with lid 58 for 270° rotation. The same shaft 27 and sector 47 are used with both lids. Accordingly, a user can purchase and assemble either lid to a container, and, at a future time should the need arise, replace the initial lid with the other lid without having to replace the container.

As shown in FIG. 8, the top of container 3 has a rolled lip **3*a* which cooperates with a rolled lip 19*a* on cover 19 (FIG. 1**) to provide a tight seal between container and cover when the cover is in closed position.

In carrying out the present invention, provision is made for improving the process by which the receptacle 1 is manufactured. Looking at FIGS. 10 and 11, the receptacle is molded as a single piece, with the lid 19 or 58 on top of the container 3, and with the lid arms 35 or 60 reversed 180° from the container handle 18. To remove the receptacle from the mold, the parting line 75 must pass through the centers of the container shafts 27 and the lid openings 45 (FIGS. 5 and 6). An S-shaped container lip 77 allows this by enabling the parting line 75 to be at or below the top of the container 3, FIGS. 13 and 14. This advantage of the manufacturing process of the present invention is that the S-shaped container lip (FIGS. 13 and 14) allows the parting line 75 to be in a single plane to thus facilitate removal of the molded receptacle from the mold.

Thus, it is apparent that there has been provided, in accordance with the invention, a refuse container with snap-on cover that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A receptacle comprising:

a. a container body means having upstanding side walls, a floor, and an open top, said container body having a shaft integrally joined thereto;

b. a lid means comprising a cover portion having a size and shape to fit over the container open top, said lid having a pair of arms extending therefrom, c. hinge means for pivotally mounting said lid means on said container body means for movement between closed and an open positions, said hinge means including cam means for enabling the lid to be pivoted freely from a first closed position then through a first predetermined angle to an intermediate position and then in a controlled manner from the intermediate position through a second predetermined angle to a third position;

d. said cam means comprising:

1) a first arcuate surface formed on at least one arm of the lid and concentric with the container shaft longitudinal axis;

2) a second arcuate surface formed on the lid arm and concentric and coplanar with the first arcuate surface;

3) a generally flat surface tangential to the lid arm second arcuate surface and extending therefrom to intersect the arm first arcuate surface at an intersection point; and 4) a sector joined to the shaft of the associated container shaft and extending radially therefrom and being concentric with the lid arm arcuate surfaces, the sector having an end face and a periphery with a radius slightly less than the radius of the lid arm first arcuate surface and slightly greater than the radius of the lid arm second arcuate surface, the sector end face being a predetermined angular distance from the lid arm intersection point and the sector being radially aligned with the lid arm first arcuate surface when the lid is in the first position, so that the lid may be rotated freely from the first position thereof to the intermediate position whereat the lid arm tangential surface contacts the container sector and in a controlled manner from the intermediate position to the third position due to camming action between the container sector and the lid arm tangential and second arcuate surfaces.

2. The apparatus of claim 1 wherein the container sector end face is approximately 75° from the lid arm intersection point when the lid is in the first position thereof, and wherein the second arcuate surface subtends an angle of approximately 155° about the container shaft axis, the lid may be pivoted freely through an angle of approximately 90° from the first position to the intermediate position and in a controlled manner through approximately 180° from the intermediate position to the third position.

3. A receptacle comprising:

a. a container having upstanding side walls, a floor, and an open top;

b. an elongated handle connected to the container back wall near the open top and having opposed ends;

c. a shaft joined to and extending outwardly from each end of the handle and terminating in a mushroom-shaped surface, the mushroom-shaped surfaces of the shafts having respective bases that diverge toward each other; and d. a lid comprising a cover portion having a size and shape to fit over the container open top, and a pair of arms extending from the cover portion and having respective inwardly facing surfaces spaced apart a distance slightly greater than the distance between the ends of the container handle, each lid arm being fabricated with a wall defining an opening therethrough having a diameter slightly greater than the diameter of the container shafts, so that the lid arm wall openings can be forced over the mushroom-shaped surfaces of the corresponding container shafts to be captured thereon between the mushroom-shaped surfaces and the ends of the handles and thereby form a hinge between the container and lid;

e. each container shaft is fabricated with a neck portion adjacent the base of the associated mushroom-shaped surface, the neck having a diameter slightly less than the diameter of the lid arm wall opening, so that the arm wall opening is captured in the shaft neck when the lid is hinged to the container;

f. at least one container shaft is formed with a radially extending sector located adjacent the shaft neck and having a first end face; and g. a lid arm is formed with a recess partially bounded by a stepped surface radially aligned with the container sector, the lid stepped surface being located at a predetermined angle from the container sector first end face when the lid is in a first position whereat it is closed over the container open top, the lid stepped surface abutting the sector first end face when the lid is pivoted from the first closed position through the predetermined angle to thereby stop the lid from further pivoting.

4. A receptacle comprising:

a. a container having upstanding side walls, a floor, and an open top;

b. an elongated handle connected to the container back wall near the open top and having opposed ends;

c. a shaft joined to and extending outwardly from each end of the handle and terminating in a mushroom-shaped surface, the mushroom-shaped surfaces of the shafts having respective bases that diverge toward each other; and d. a lid comprising a cover portion having a size and shape to fit over the container open top, and a pair of arms extending from the cover portion and having respective inwardly facing surfaces spaced apart a distance slightly greater than the distance between the ends of the container handle, each lid arm being fabricated with a wall defining an opening therethrough having a diameter slightly greater than the diameter of the container shafts, so that the lid arm wall openings can be forced over the mushroom-shaped surfaces of the corresponding container shafts to be captured thereon between the mushroom-shaped surfaces and the ends of the handles and thereby form a hinge between the container and lid;

e. a radially extending sector joined to at least one of the container shafts, the sector having a periphery with a predetermined radius and a first end face;

f. a first arcuate surface formed in the corresponding lid arm and having a radius slightly greater than the radius of the container sector periphery, the lid first arcuate surface being in radial alignment with the container sector;

g. a second arcuate surface formed in the corresponding lid arm and having a radius slightly less than the radius of the sector periphery and it being in radial alignment therewith; and h. a generally flat surface extending between the arm first and second arcuate surfaces and being tangential to the second arcuate surface, the container sector being proximate the lid arm first arcuate surface and the tangential surface intersecting the first arcuate surface at a point located at a predetermined angle from the container sector first end face when the lid is in a first closed position horizontal over the container open top, so that the lid may be rotated freely from the first position thereof through approximately the predetermined angle until the arm tangential surface contacts the container sector first end face and further lid rotation to a third position causes the container sector periphery to initially contact the lid tangential surface and subsequently the second arcuate surface in a camming action that slows the lid rotation to thereby control lid opening to the third position.

5. The receptacle of claim 4 wherein the lid tangential surface intersects the first arcuate surface at a point that is approximately 75° from the container sector first end face when the lid is in the first position thereof, and wherein the lid can be rotated freely through an angle of approximately 90° before the lid tangential surface contacts the container sector first end face to begin the camming action therebetween.

6. A receptacle comprising:

a. a container having upstanding side walls, a floor, and an open top;

b. an elongated handle connected to the container back wall near the open top and having opposed ends;

c. a shaft joined to and extending outwardly from each end of the handle and terminating in a mushroom-shaped surface, the mushroom-shaped surfaces of the shafts having respective bases that diverge toward each other; and d. a lid comprising a cover portion having a size and shape to fit over the container open top, and a pair of arms extending from the cover portion and having respective inwardly facing surfaces spaced apart a distance slightly greater than the distance between the ends of the container handle, each lid arm being fabricated with a wall defining an opening therethrough having a diameter slightly greater than the diameter of the container shafts, so that the lid arm wall openings can be forced over the mushroom-shaped surfaces of the corresponding container shafts to be captured thereon between the mushroom-shaped surfaces and the ends of the handles and thereby form a hinge between the container and lid;

e. a sector formed on at least one container shaft and having a first radially extending end face; and f. a stepped surface formed in the corresponding lid arm and radially aligned with the container sector, the lid arm stepped surface being approximately 100° from the sector first end face when the lid is in a first position whereat it is generally horizontal and covers the container open top, so that the lid may be pivoted through an angle of approximately 100° to a second position whereat the lid arm stepped surface abuts the container sector first end face to enable the lid to remain in a generally vertical open position;

g. at least one of the container shafts is formed with a sector adjacent the shaft groove and extending radially from the shaft, the sector having a predetermined radius and an end face; and h. at least one lid arm is formed with a recess radially aligned with and receiving the container sector, the recess being defined by a first arcuate surface having a radius slightly greater than the sector radius and by a second arcuate surface having a radius slightly less than the sector radius and a surface tangential to the second arcuate surface and intersecting the first arcuate surface at an intersection point, the intersection point being located at a predetermined angle from the container sector end face and the lid arm first arcuate surface being radially aligned with the container sector when the lid is in a closed position overlying the container open top, so that the lid may be pivoted freely from the closed position through approximately the predetermined angle to an intermediate position whereat the lid tangential surface contacts the container sector and the lid may be rotated from the intermediate position to a third position in a controlled manner by frictional contact between a container sector and the lid tangential and second arcuate surfaces.

7. Apparatus for storing selected materials comprising:

a. a container comprising four interconnected walls arranged to form an open top, and a handle having opposed ends and being connected to one of the walls adjacent the open top thereof;

b. a lid comprising a cover portion sized to selectively fit over and close the container open top; and c. hinge means for pivotally joining the lid to the container comprising:

(i) a pair of shafts having concentric longitudinal axes, a shaft extending oppositely from each end of the container handle; and (ii) a pair of arms joined to and extending from the lid cover portion, each arm being formed with a middle wall having an opening therein that receives an associated shaft of the container;

d. each container shaft has a mushroom-shaped surface and is formed with a circumferential groove adjacent the mushroom-shaped surface; and e. the opening in the middle wall in each lid arm is captured in the associated container shaft groove;

f. each lid arm is fabricated with an inwardly facing surface proximate the associated container handle end, the inwardly facing surface defining a recess that is bounded in part by the middle wall and that surrounds the container shaft;

g. a sector is joined to at least one of the container shafts and extends radially therefrom into the recess of the corresponding lid arm, the sector having a periphery with a predetermined radius and an end face; and h. the lid arm recess is defined by a first arcuate surface having a radius slightly greater than the sector radius, a second arcuate surface having a radius slightly less than the sector radius, and a generally flat surface extending tangentially from the second arcuate surface to an intersection point with the first arcuate surface, the container sector being proximate the lid arm first arcuate surface and the intersection point being located at a predetermined angular distance from the container sector end face when the lid is in the first closed position thereof to thereby enable the lid to be freely rotated on the container shafts to an intermediate position whereat the lid tangential surface contacts the container sector and to enable the lid to be further rotated to a third position in a controlled manner through camming frictional contact between the container sector periphery and the lid arm tangential and second arcuate surfaces.

8. The apparatus of claim 7 wherein the predetermined angular distance between the container sector end face and the lid arm intersection point is approximately 75°.

9. The apparatus of claim 7 wherein:

a. the predetermined angular distance between the container sector end face and the lid arm intersection point is approximately 75°;

b. the lid tangential surface subtends an angle of approximately 30° about the container shaft longitudinal axis; and c. the lid arm recess second arcuate surface subtends an angle of approximately 155° about the shaft longitudinal axis; and d. the lid is freely pivotable through an angle of approximately 90° between the first and intermediate positions and the lid is pivotable in a controller manner through a further angle of approximately 180°.

10. Apparatus for storing selected materials comprising:

a. a container comprising four interconnected walls arranged to form an open top, and a handle having opposed ends and being connected to one of the walls adjacent the open top thereof;

b. a lid comprising a cover portion sized to selectively fit over and close the container open top; and c. hinge means for pivotally joining the lid to the container comprising:

(i) a pair of shafts having concentric longitudinal axes, a shaft extending oppositely from each end of the container handle; and (ii) a pair of arms joined to and extending from the lid cover portion, each arm being formed with a middle wall having an opening therein that receives an associated shaft of the container;

d. the hinge means further comprises cam means for enabling the lid to be pivoted freely from a first position whereat it is closed over the container open top through a first predetermined angle to an intermediate position and in a controlled manner from the intermediate position through a second predetermined angle to a third position;

e. a first arcuate surface formed on at least one arm of the lid and concentric with the container shaft longitudinal axis;

f. a second arcuate surface formed on the lid arm and concentric and coplanar with the first arcuate surface;

g. a generally flat surface tangential to the lid arm second arcuate surface and extending therefrom to intersect the arm first arcuate surface at an intersection point; and h. a sector joined to the shaft of the associated container shaft and extending radially therefrom and being concentric with the lid arm arcuate surfaces, the sector having an end face and a periphery with a radius slightly less than the radius of the lid arm first arcuate surface and slightly greater than the radius of the lid arm second arcuate surface, the sector end face being a predetermined angular distance from the lid arm intersection point and the sector being radially aligned with the lid arm first arcuate surface when the lid is in the first position, so that the lid may be rotated freely from the first position thereof to the intermediate position whereat the lid arm tangential surface contacts the container sector and in a controlled manner from the intermediate position to the third position due to camming action between the container sector and the lid arm tangential and second arcuate surfaces.

11. The apparatus of claim 10 wherein the container sector end face is approximately 75° from the lid arm intersection point when the lid is in the first position thereof, and wherein the second arcuate surface subtends an angle of approximately 155° about the container shaft axis, the lid may be pivoted freely through an angle of approximately 90° from the first position to the intermediate position and in a controlled manner through approximately 180° from the intermediate position to the third position.

12. A receptacle comprising:

a. a container body means having upstanding side walls, a floor, and an open top;

b. a lid means comprising a cover portion having a size and shape to fit over the container open top;

c. hinge means for pivotally mounting said lid means on said container body means for movement between closed and open positions, said hinge means including a pair of shaft members on said container body means, said shaft members journaled in openings in said lid means, said hinge means further including cam means for enabling the lid to be pivoted from a first closed position, then through a first intermediate angle to an intermediate position, and then in a controlled manner from the intermediate position through a second predetermined angle to the fully open position;

d. said cam means comprising:

1) a sector portion formed on at least one of said shaft members, said sector portion extending radially from said one shaft member;

2) a first arcuate surface formed on at least one arm of said lid means;

3) a second arcuate surface formed on said lid arm means on which said first arcuate surface is formed, said second arcuate surface defining a continuation of said first arcuate surface, said second arcuate surface having a radius slightly less than the radius of said sector portion so that as the lid pivots between the intermediate position and the fully open position, it will move in a controlled manner that allows a smooth and safe descent, said lid control movement being achieved by the frictional contact between said sector portion and said second arcuate surface.

13. Apparatus for storing selected materials comprising:

a. a container body means having upstanding side walls, a floor, and an open top, said container body means having a handle with opposed ends and being connected to one of the walls adjacent the open top;

b. a lid means comprising a cover portion having a size and shape to fit over the container open top;

c. hinge means for pivotally joining the lid means to the container body means comprising:

1) a pair of shaft members extending oppositely from each end of said container handle; and 2) a pair of arm members joined to and extending from the lid means, each arm having an opening therein that receives one of said shafts;

d. said hinge means further including cam means for enabling the lid to be pivoted from a first closed position, then through a first intermediate angle to an intermediate position, and then in a controlled manner from the intermediate position through a second predetermined angle to the fully open position;

e. said cam means comprising:

1) a sector portion formed on at least one of said shaft members, said sector portion extending radially from said one shaft member;

2) a first arcuate surface formed on at least one arm of said lid means;

3) a second arcuate surface formed on said lid arm means on which said first arcuate surface is formed, said second arcuate surface defining a continuation of said first arcuate surface, said second arcuate surface having a radius slightly less than the radius of said sector portion so that as the lid pivots between the intermediate position and the fully open position, it will move in a controlled manner that allows a smooth and safe descent, said lid control movement being achieved by the frictional contact between said sector portion and said second arcuate surface;

f. said hinge means being further characterized wherein said arm members are adapted to be flexed slightly to facilitate insertion of said shaft members into said openings in said arms.

* * * * *